US005655683A

United States Patent [19]

Goth

[11] Patent Number: 5,655,683

[45] Date of Patent: Aug. 12, 1997

[54] CLOSURE FLAP

[75] Inventor: Gerhard Goth, Benningen, Germany

[73] Assignee: Filterwerk Mann & Hummel GmbH, Ludwigsburg, Germany

[21] Appl. No.: 402,061

[22] Filed: Mar. 9, 1995

[30] Foreign Application Priority Data

Mar. 9, 1994 [DE] Germany ..... 44 07 783.1

[51] Int. Cl.[6] ..... B67B 7/00

[52] U.S. Cl. ..... 222/1; 222/500; 222/504; 222/556

[58] Field of Search ..... 222/1, 491, 500, 222/504, 556

[56] References Cited

U.S. PATENT DOCUMENTS

| | | | |
|---|---|---|---|
| 2,501,743 | 3/1950 | Schellentrager . | |
| 3,906,850 | 9/1975 | Papai | 222/565 X |

FOREIGN PATENT DOCUMENTS

| | | |
|---|---|---|
| 1393828 | 2/1965 | France . |
| 2260522 | 9/1975 | France . |
| 243627 | 5/1911 | Germany . |
| 462875 | 7/1928 | Germany . |
| 725208 | 9/1942 | Germany . |
| 1043132 | 11/1958 | Germany . |
| 76423 | 9/1970 | Germany . |
| 2505615 | 8/1975 | Germany . |
| 7531712 | 1/1976 | Germany . |
| 2531691 | 2/1977 | Germany . |
| 183266 | 7/1922 | United Kingdom . |

*Primary Examiner*—Gregory L. Huson
*Attorney, Agent, or Firm*—Evenson, McKeown, Edwards & Lenahan P.L.L.C.

[57] ABSTRACT

The invention relates to a process and an apparatus for closing and/or opening a hopper or container (5) with a bottom outlet. A flap (7) fastened to at least one lever mechanism (2) is urged toward a closed position by means of a counterweight (6) mounted on the opposite end of the lever mechanism (2). At least one driving element (9) operatively connected to the shaft (8) supporting the lever mechanism (2), via a partial free wheel mechanism composed of a pair of conditional forcible drive members (3, 4) mounted on the shaft, promotes the closing of the flap (7) when the force of gravity acting on the counterweight does not bring the flap to the fully closed position. After the filling of the container (5) is completed, the partial free wheel or the conditional forcible drive (3) facilitates the opening of the container (5) outlet by deactuating the drive element (9) to release the lever mechanism (2) so that the flap (7) can be opened by the force of gravity acting on the material in the container resting on the flap (7).

20 Claims, 3 Drawing Sheets

CLOSURE FLAP

BACKGROUND OF THE INVENTION

This invention relates to a process for closing and/or opening a hopper or other container with a bottom outlet.

Processes of this type are known in practice and are operated entirely by the force of gravity. If such a process is to be integrated, for example, into the material supply of an injection molding machine, it is a disadvantage that the closing flap frequently does not close completely, particularly when the flow behavior of the material presents problems.

An elaborate operating control could be provided via sensors and drives. However, this would be costly and would make the process more expensive.

Thus, there has remained a need for an improved process and apparatus for closing and/or opening a hopper or other container with a bottom outlet.

SUMMARY OF THE INVENTION

It is therefore an object of the invention to provide and improved process for closing and/or opening a container with bottom outlet which process is easy to apply, is inexpensive, and operates reliably.

It is also an object of the invention to provide an apparatus for implementing such a process.

According to the invention these objects are achieved in that a flap fastened on at .least one lever mechanism is brought into a closed position by means of a counterweight mounted on the opposite end of the lever mechanism, whereby closing of the flap is promoted by at least one driving member operatively connected to the shaft carrying the lever mechanism via a partial free wheel or a conditional forcible drive mounted on the shaft and wherein the process comprises the following steps: The hopper is filled; after completion of the filling of the hopper, the partial free wheel or conditional forcible drive and the drive element release the closure flap so that the passage from the hopper can open up; the closure flap is opened by the weight of the material disposed on the flap; the hopper is emptied under the influence of gravity; and the flap is then brought to the closed position by means of the counterweight fastened on the lever mechanism.

The mechanism for opening the flap is actuated mainly by the force of the weight of the conveyed material situated in the hopper and the mechanism for closing the flap is actuated mainly by the force of gravity acting on the counterweight. If the closure flap is hindered from closing completely due to the presence of material residues on the flap, then the driving element acts through the conditional forcible drive members to promote or assist in the closing of the flap. Thus, if residues of material on the flap prevent the flap from completely sealing the outlet of the hopper, the driving element and the conditional forcible drive members can be used to assist in holding the flap in the closed position, thereby keeping the material in the hopper. Any suitable type of driving element may be used. For example, the driving element may be a pneumatic or electric or hydraulic driving element.

An advantageous further embodiment of the invention provides that the actuation of the driving element occurs in parallel to that of an operating valve.

This type of an existing operating valve (e.g. a quenching valve, reversing valve, or blow out valve), which is involved in the discharge or conveyance of the material from the hopper, does not result in any additional costs, and its control signal also can be used in a simple manner to control the aforementioned driving element.

An apparatus for carrying out the process of the invention is also claimed which comprises at least one lever mechanism having a flap mounted on one end thereof, a shaft which supports the lever mechanism, and a driving member which is operatively connected to of the shaft.

An advantageous further embodiment provides that an adjustable counterweight is mounted on the opposite end of the lever mechanism from the flap.

The advantage in this case is that it becomes possible to make use of different types of adjusting forces.

Furthermore, in a particularly advantageous embodiment of the invention, the shaft may be operatively connected to the driving element through a conditional forcible drive mechanism or partial free wheel.

This assures complete operational reliability. If the conveyed material does not tend to bridge or stick to the flap, etc., then the apparatus will be gravity operated. But if disturbances arise in the flow behavior of the material with the result that residues of material remain on the flap and hinder its closure, then the driving element will act through the conditional forcible drive mechanism or partial free wheel to assure a proper flow of material, i.e. to assure that the passageway is open only at appropriate time intervals.

Advantageous further embodiments are set forth in the dependent claims.

These and other features of preferred embodiments of the invention, in addition to being set forth in the claims, are also disclosed in the specification and/or the drawings, and the individual features in embodiments of the invention each may be implemented either individually or in the form of subcombinations of two or more features and can be applied to other fields of use and may constitute advantageous, separately protectable constructions for which protection is also claimed.

BRIEF DESCRIPTION OF THE DRAWINGS

The invention will be described in further detail with reference to an illustrative preferred embodiment depicted in the accompanying drawings in which.

DETAILED DESCRIPTION OF PREFERRED EMBODIMENTS

Figure 1:
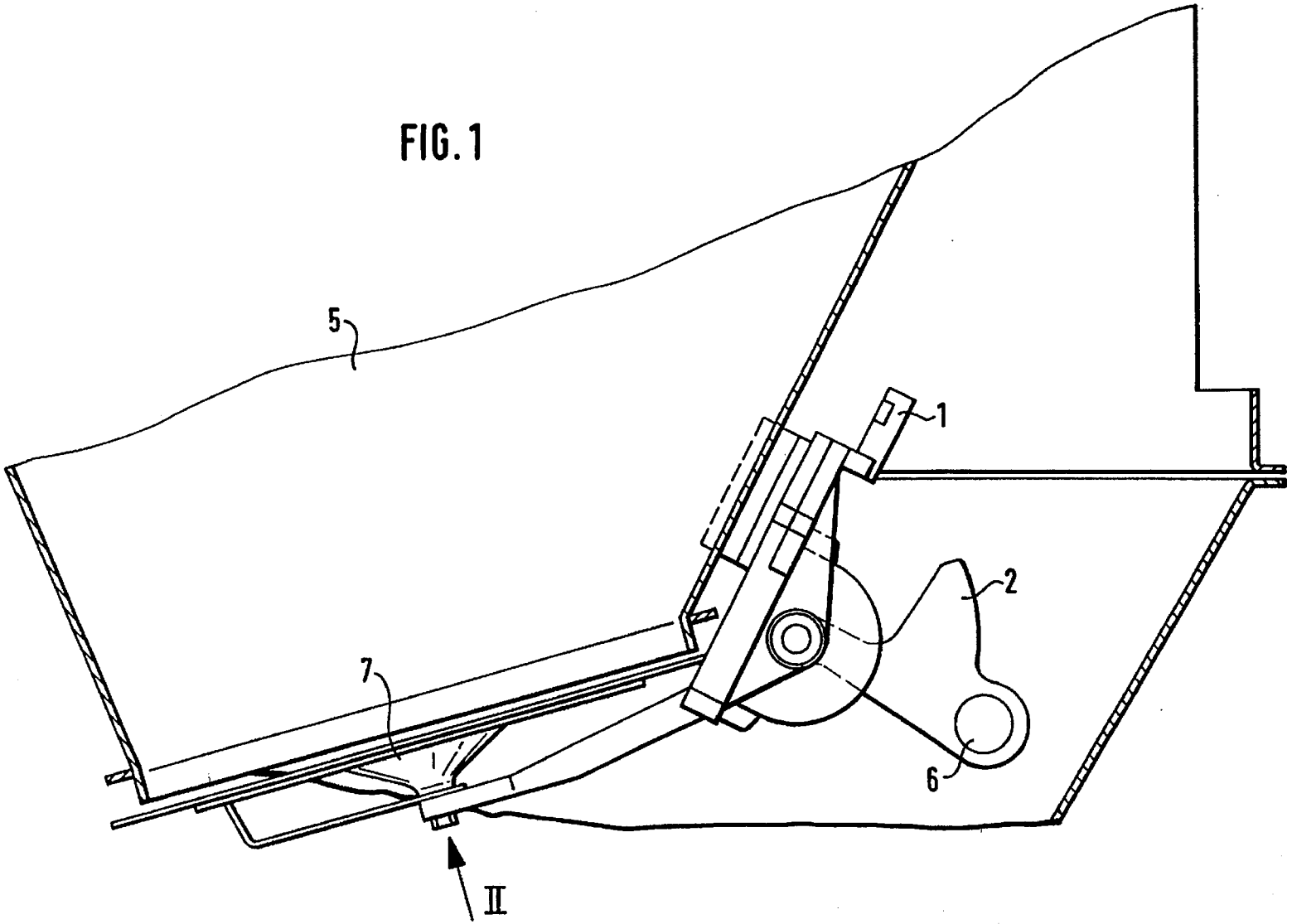
FIG. 1 is a side view of an apparatus according to the invention for carrying out the process of the invention.
Figure 2:
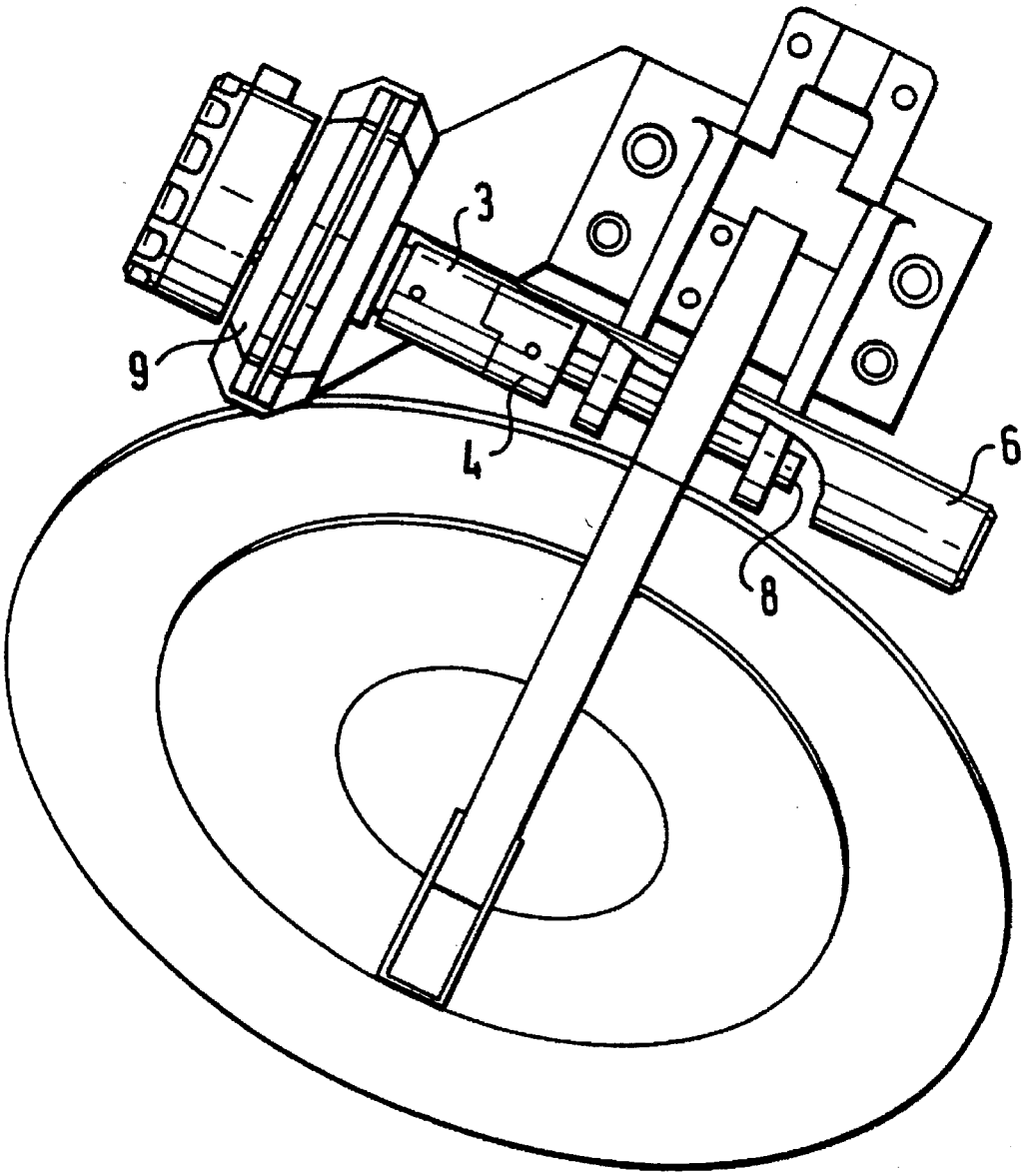
FIG. 2 is a bottom view seen in the direction of the arrow II.

The lever mechanism 2 is secured to the hopper 5 by the mounting bar 1. Lever mechanism 2 is connected with the shaft 8 which in turn is connected with the partial free wheel mechanism which is comprised of conditional forcible drive members 3 and 4. Forcible drive member 3 is operatively engaged by the driving element 9.

A closure flap 7, which is fastened on a lever mechanism 2, is closed as a result of action of the force of gravity on the counterweight 6. In order to open the flap 7, the driving element 9 rotates the partial free wheel mechanism or conditional forcible drive member 3 into an advanced position in which the flap by means of the lever mechanism 2 releases the granulates as a result of the weight exerted on the flap 7 by the conveyed granulates under the influence of gravity. Thereafter, the flap 7 closes again under the influence of gravity on the counterweight 6 attached to the lever mechanism 2. If residual granulates or the like on the flap prevent the flap from closing completely, then the driving element 9, which is connected to operate in parallel with an operating valve (squeeze valve, reversing valve, or blow-out valve) used in the process, supports or promotes the closing operation through the partial free wheel mechanism comprised of conditional forcible drive members 3 and 4.

Figure 3A:
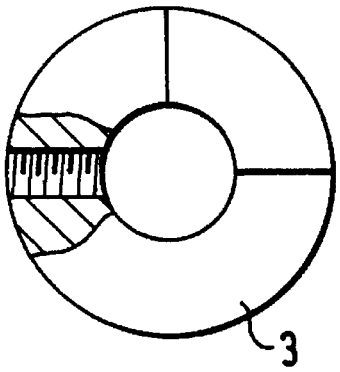
FIGS. 3*a* and *b* are views of the partial free wheel or restricted guidance member 3.
Figure 3B:
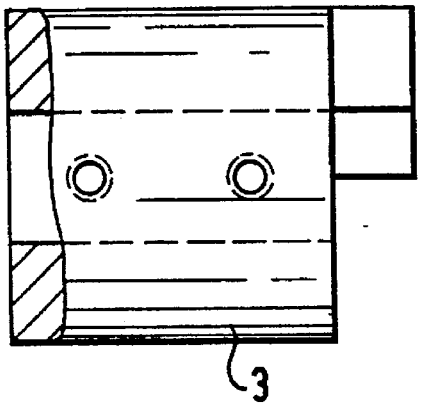
Figure 4A:
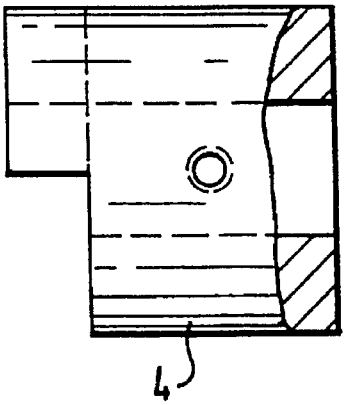
FIGS. 4*a* and *b* are views of the partial free wheel or restricted guidance member 4.
Figure 4B:
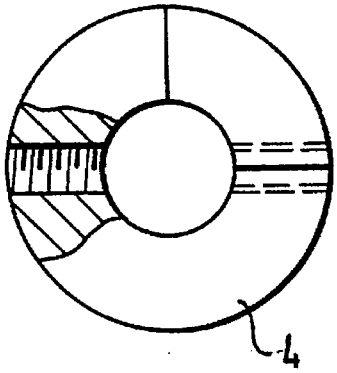

The lever system comprises the lever mechanism 2, the counterweight 6, the flap 7, the shaft 8 and the forcible drive member 4, which is rigidly connected therewith. When the lever system is at rest, it closes the opening at the bottom of the empty container 5 by means of a light pressure exerted by the force of gravity acting on the counterweight 6. During the filling of container 5 with granular material (e.g. plastic granules to be introduced into a molding machine), the drive element 9 supports the flap 7 through the forcible drive member 3, which is connected therewith by means of screws, so that the flap remains in the closed position. This is done by actuating drive element 9 such that it positions and fixes the forcible drive member 3 immediately adjacent the forcible drive member 4 such that projecting pins on the forcible drive members 3 and 4 (see FIGS. 3*b*, 4*a*) interengage and drive member 4 is thereby secured against rotation. The forcible drive members 3 and 4 engage each other as two stub shafts without being keyed to each other.

After container 5 has been filled to the desired level, the drive element 9 releases the forcible drive member 3 from its fixed position and moves or rotates it through, for example, a 90° angle, so that a partial free rotation angle is produced for the partial free wheel or forcible drive member 4. This free rotation angle makes it possible for drive member 4 to pivot within the range of the free rotation angle together with the shaft 8 to which it is secured and lever mechanism 2 which is secured to shaft 8. Consequently, the flap 7 pivots away from the opening at the bottom of the previously filled container 5 as a result of the force of gravity acting on the contents of the container, thereby opening the container and allowing the contents of the container to be discharged.

After the container 5 is empty again, the flap 7 is pivoted again by means of the above-described lever system toward the container opening in order to close the opening. If the flap 7 is not completely free of granular material, so that difficulties are encountered in completely closing the bottom opening, the drive element 9 rotates the forcible drive member 3 toward the forcible drive member 4 such that their stub shafts engage again in order to support forcible drive member 4 and secure drive member 4 and the attached lever mechanism 2 in the closed position so that the container 5 can be filled again.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations falling within the scope of the appended claims and equivalents thereof.

What is claimed is:

1. A method of opening and closing a container having a bottom outlet; a closure flap fastened to a first end of a lever mechanism supported on a shaft and movable between a closed position in which said outlet is closed by said flap and an open position in which said flap is moved away from said outlet; a counterweight mounted on a second end of said lever mechanism such that gravity acting on said counterweight will urge said flap toward said closed position; and a driving element operatively connected to said shaft through a partial free wheel mechanism such that actuation of said driving element assists in moving said flap to and holding said flap in said closed position; said method comprising the steps of:

filling said container with a flowable material such that flowable material in said container rests on said flap in the closed position;

after filling of said container, deactuating said driving element to release said partial free wheel and said lever mechanism and allowing gravity acting on the flowable material resting on said flap to force the flap away from said bottom outlet and empty said container of flowable material through said outlet; and after the flowable material has been emptied from said container so that no more flowable material rests on said flap, allowing gravity acting on said counterweight to move said flap back to the closed position and actuating said driving element to hold said flap in the closed position.

2. A method according to claim 1, wherein said partial free wheel mechanism comprises a pair of interengaging conditional forcible drive members.

3. A method according to claim 1, wherein said container is provided with an operating valve which is actuated to fill the container, said method further comprising actuating said driving element to assist in closing said outlet in parallel with the actuation of said operating valve.

4. An apparatus .for opening and closing a container having a bottom outlet, said apparatus comprising a closure flap fastened to a first end of a lever mechanism supported on a shaft and movable between a closed position in which said outlet is closed by said flap and an open position in which said flap is moved away from said outlet; a counterweight mounted on a second end of said lever mechanism such that gravity acting on said counterweight will urge said flap toward said closed position; and a selectively actuatable driving element operatively connected to said shaft such that actuation of said driving element assists in moving said flap to and holding said flap in said closed position.

5. An apparatus according to claim 4, wherein said counterweight is adjustable to vary the force urging said flap toward said closed position.

6. An apparatus according to claim 4, wherein said driving element is operatively connected to said shaft, which supports said lever mechanism, through a partial free wheel mechanism.

7. An apparatus according to claim 6, wherein said partial free wheel mechanism comprises a pair of interengaging conditional forcible drive members.

8. An apparatus according to claim 4, wherein said driving element is a pneumatic or electric or hydraulic driving element.

9. An apparatus according to claim 7, wherein a first of said drive members is non-rotatably connected to said shaft, and wherein a second of said drive members is rotatable with respect to said shaft and is operatively connected to said driving element.

10. An apparatus according to claim 7, wherein each of said drive members comprises a projecting pin extending axially with respect to an axis of rotation of said shaft.

11. An apparatus according to claim 7, wherein each of said drive members comprises an annular shaft and a projecting pin extending axially from said annular shaft.

12. An apparatus according to claim 11, wherein a first of said drive members is non-rotatably connected to said shaft, and wherein a second of said drive members is rotatable with respect to said shaft and is operatively connected to said driving element.

13. An apparatus according to claim 10, wherein said drive members are arranged concentrically with respect to said axis of rotation of said shaft, and wherein said projecting pins are selectively engageable with each other by way of said driving element.

14. An apparatus according to claim 12, wherein said drive members are arranged concentrically with respect to an axis of rotation of said shaft, and wherein said projecting pins are selectively engageable with each other by way of said driving element.

15. A method according to claim 2, wherein a first of said drive members is non-rotatably connected to said shaft, and wherein a second of said drive members is rotatable with respect to said shaft and is operatively connected to said driving element.

16. A method according to claim 2, wherein each of said drive members comprises a projecting pin extending axially with respect to an axis of rotation of said shaft.

17. A method according to claim 2, wherein each of said drive members comprises an annular shaft and a projecting pin extending axially from said annular shaft.

18. A method according to claim 17, wherein a first of said drive members is non-rotatably connected to said shaft, and wherein a second of said drive members is rotatable with respect to said shaft and is operatively connected to said driving element.

19. A method according to claim 16, wherein said drive members are arranged concentrically with respect to said axis of rotation of said shaft, and wherein said projecting pins are selectively engageable with each other by way of said driving element.

20. A method according to claim 18, wherein said drive members are arranged concentrically with respect to an axis of rotation of said shaft, and wherein said projecting pins are selectively engageable with each other by way of said driving element.

* * * * *